United States Patent [19]

Moberly

[11] 4,402,368

[45] Sep. 6, 1983

[54] EARTH SCRAPER AND GROUND SUPPORT THEREFOR

[76] Inventor: Frank Moberly, P.O. Box 3212, Napa, Calif. 94558

[21] Appl. No.: 856,245

[22] Filed: Dec. 1, 1977

[51] Int. Cl.[2] ..... A01B 6/22; E02F 3/76

[52] U.S. Cl. ..... 172/4.5; 172/414; 172/625

[58] Field of Search ..... 172/4, 4.5, 240, 242, 172/243, 311, 315, 316, 326, 327, 328, 395, 396, 413, 456, 625, 619, 414; 37/DIG. 20; 280/126, 127; 404/84

[56] References Cited

U.S. PATENT DOCUMENTS

| | | | |
|---|---|---|---|
| 3,009,271 | 11/1961 | Kuehne et al. | 172/4.5 |
| 3,261,118 | 7/1966 | Litherland | 172/240 |
| 3,376,937 | 4/1968 | Groberg | 172/780 |
| 3,561,538 | 2/1971 | Curlett et al. | 172/4.5 |
| 3,721,461 | 3/1973 | Nelsen et al. | 172/625 X |
| 3,953,145 | 4/1976 | Teach | 404/84 |
| 4,031,963 | 6/1977 | Poggemiller et al. | 172/4 |

FOREIGN PATENT DOCUMENTS

| | | | |
|---|---|---|---|
| 2526262 | 12/1976 | Fed. Rep. of Germany | 172/619 |
| 40888 | 7/1958 | Poland | 172/4 |

*Primary Examiner*—Richard T. Stouffer

*Attorney, Agent, or Firm*—Manfred M. Warren; Robert B. Chickering; Glen R. Grunewald

[57] ABSTRACT

A surface grading device adapted to be towed over a surface to be graded, capable of self adjustment in accordance with a pre-established signal such as a laser beam, capable of grading cross sloping surfaces, capable of minimizing blade deflection caused by carrier wheels hitting a flaw in grade, and adaptable for highway towing along a single lane of a highway.

9 Claims, 9 Drawing Figures

EARTH SCRAPER AND GROUND SUPPORT THEREFOR

The present invention relates in general to earth grading devices, and in particular to a class of earth scraper adapted to be towed behind a tractor or similar apparatus across the surface to be graded, and whose grading plane is automatically controlled by a receiver intercepting a signal, such as that issuing from a laser transmitter located somewhere on the surface to be graded.

These devices generally consist of a pair of wheels depending from a frame which adjustably supports scraping apparatus of some nature including a scraping blade. A laser receiver generally is rigidly associated with the blade, in position to intercept a laser beam that is transmitted, usually from the center of the field. This receiver has the ability to sense its position relative to this beam and to activate controls that attempt to adjust the blade position relative to the carrier wheels so the receiver may maintain a predetermined position relative to the beam.

Consequently, in a grading position, a change in ground level will be detected by a change in relationship between the laser beam and laser receiver, and the receiver will activate controls to change the blade relationship to the carrier wheels to compensate for the surface irregularity that caused this change in relationship.

At higher grading speeds, errors in grade cause compensating adjustment which may not be completed before the surface with this irregularity is passed over. This may cause an end of the blade to dig into the surface and subsequently, instigate another compensating adjustment as a carrier wheel enters this newly cut depression. Thus, at the higher speeds, oscillating motion of the blade could occur, resulting in ripples in the graded surface. This oscillating action, some times called duck-walk, continues placing these ripples in this surface until the scraper is stopped and restarted slowly to re-establish a smooth surface. This results in a lower production, error in grade, and inability to automate through laser controls at higher grading speeds.

Because of the rigid construction and rotatability in one direction only of these current grading devices, they are limited in their adjustability and confined to operation in direction of the slope of the surface to be graded. They are therefore unable to correct for cross sloping surfaces.

Transporting this grading equipment to and from the grading site is currently done by dismantling the grader and putting all the disessembled parts onto a trailer for movement.

Among the objects of my invention are:

(1) To provide novel and improved earth grading equipment;

(2) To provide novel and improved earth grading equipment that minimizes the creation oscillations;

(3) To provide novel and improved earth grading equipment that can operate at high grading speeds;

(4) To provide novel and improved earth grading equipment that has ability to grade cross slopes;

(5) To provide novel and improved earth grading equipment that is adaptable for travel along a single lane of a highway.

Additional objects of my invention will be brought out in the following description of a preferred embodiment of the same, taken in conjunction with the accompanying drawings, wherein FIG. 1 is a three dimensional view of the invention in grading position;

Figure 1:
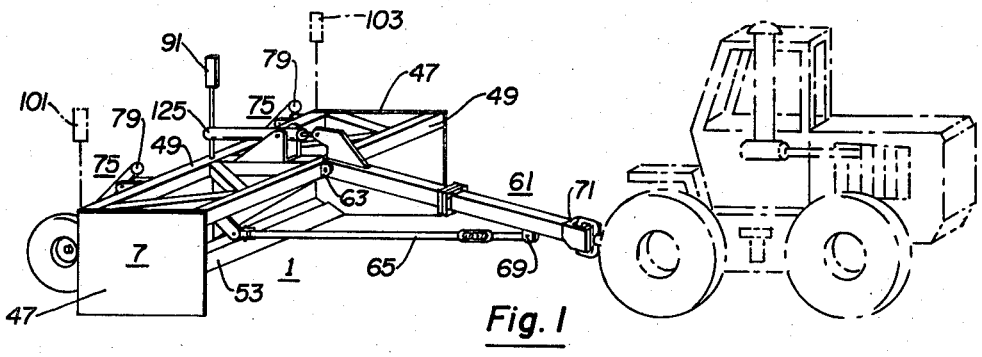
Figure 2:
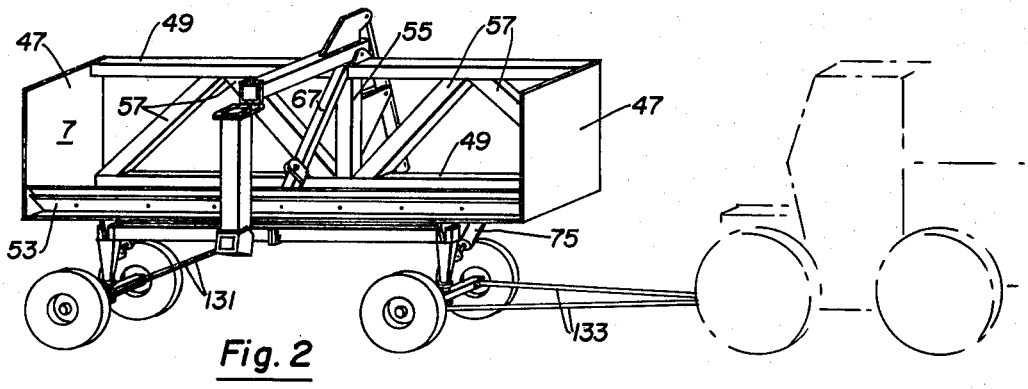
FIG. 2 is a three dimensional view of the invention in highway travel position.

Referring to the drawings for details of my invention, the same is illustrated as an earth scraping means 1 embodying features that minimize duck-walk, allow grading of cross slopes, and that will allow adaption for highway towing.

Figure 3:
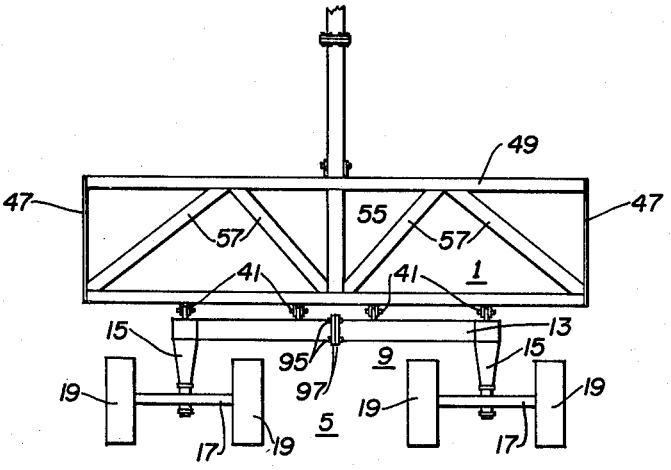
FIG. 3 is a plan view of the invention in grading position depicting the features of the ground engaging support means.

In grading position, (FIGS. 1 & 3) the same includes a ground engaging support means 5, adjustably supporting a scraper chassis assembly 7 in front thereof. The ground engaging support means includes a wheel frame assembly 9 having a cross beam 13 with an end member 15 attached at each end thereof. The unattached end of each end member is rotatably supported by a wide axle 17 having wheels 19 on each end thereof. This rotatable connection is by means of a housing 21 enclosing a bushing 23 around a shaft 25 having a threaded end and bolted to a flange 27 on the unattached end of the end member 15. This combination is inserted through an opening in the wide axle 17 center and rotatably secured thereto by means of a thrust plate 29 and wearwasher 31 on either side thereof and held in place by a washer 33 and nut 35 on the threaded end of the shaft.

The scraper chassis assembly 7 is rotatable about the cross beam 13 by means of four aligned hinges 41. This chassis assembly is comprised of a frame including end plates 47 connected on two adjacent sides by cross supports 49 and on the third side by a scraper blade 53. The assembly is reinforced structurally by a central support member 55 and ancillary structural bracing 57.

In a position for grading, the rectangular frame of the chassis assembly is forward of the ground engaging support means, with the blade 53 is proximity to the ground. A hingedly sectioned draw bar assembly 61, secured rotatably by bracket 63 from the top forward most position of the cross beam 49, is diagonally supported by a brace 65 connected at one end to an angular support member 67 by a compound hinge 68, and at the opposite end by a pin 69 to the draw bar at a point near its free end where it may be attached to a hitch 71 of a tractor for towing purposes.

To control positioning of the chassis assembly relative to the wheel assembly, a pair of hoist ram assemblies 75, each comprising a piston and rod 77, within a cylinder 79 is mounted between the two assemblies. The cylinder is rotatably connected to a flange 83 on the chassis assembly and the piston, through the rod, rotatably to an end member 15 at a point near where the axle provides its support. Hydraulic lines 87 from either end of the cylinder to the front and rear of the piston provide a flow path for hydraulic fluid to activate the piston within the cylinder. This fluid flow is regulated by a laser receiver 91 of a conventional type attached to the chassis assembly, the fluid being supplied from a reservoir and pump (not shown) located on the tractor. This receiver attempts to maintain alignment with a preadjusted position in relation to the laser beam, and by regulating fluid to these rams, adjusts itself in relation to the ground engaging support means.

The cross beam 13 of the wheel frame assembly is separable into two independent segments by removing bolts 95 through connecting flanges 97 at the center of the beam, each independent segment providing its portion of the support of the chassis assembly. With two laser receivers 101, 103, one on each end of the chassis assembly, controlling fluid independently to the proximate ram, the two axles may be raised or lowered independently. The two laser receivers may threrefore be adjusted independently with reference to the blade to allow the blade to be tilted to grade cross sloping surfaces.

When reversing direction through the field, the same controls can cause the blade to be tilted in the reverse direction.

Figure 4:
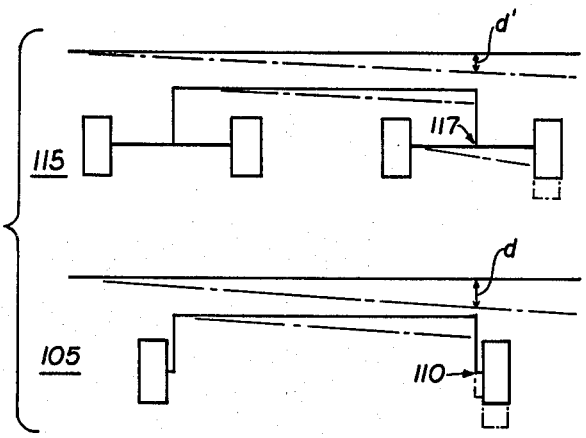
FIG. 4 is a diagrammatic representation depicting the difference in blade deflection between current grading devices and the invention.

One advantage of spaced wheels 19 on a long axle 17 is illustrated in FIG. 4 where, during a grading operation, one wheel enters into a depression in the surface being graded. It can be seen, that on a grader of the conventional type 105, the blade at the point of support 110 is lowered depth d that the wheel enters into the depression. This distance is even greater, the further the blade extends past this point of support.

With a spaced wheel grader 115 the corresponding of support 117, where the wide axle joins the end member, is lowered a lesser distance d' toward the surface then the conventional type because one wheel of the axle pair remains on the graded surface. Consequently, over the same field, a scraper with spaced wheels will produce a field with fewer errors in grade, and can traverse the field at higher grading speeds because of the minimazation of the causes of duckwalk which force the equipment to stop and start again at a slower space.

One of the major features of my invention, is the ability of the scraper to be adapted for highway towing along a single lane, eliminating the necessity for having to disassemble the unit to put it on a trailer.

Figure 5A:
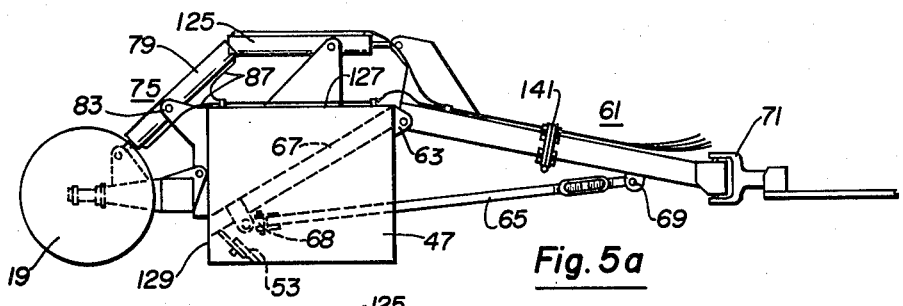
FIG. 5 is a series of views in elevation depicting successive stages in the transformation of the invention from a condition for grading to condition for highway towing.

To adapt the unit for highway towing, it is first necessary (FIG. 5*a*) to manually disconnect the diagonal brace 65 by removing the pin 69 from its point of connection at the draw bar, and rotating it about the compound hinge 68 on its other end to a position parallel to the scraper blade 53, and securing it into position thereon.

Figure 5B:
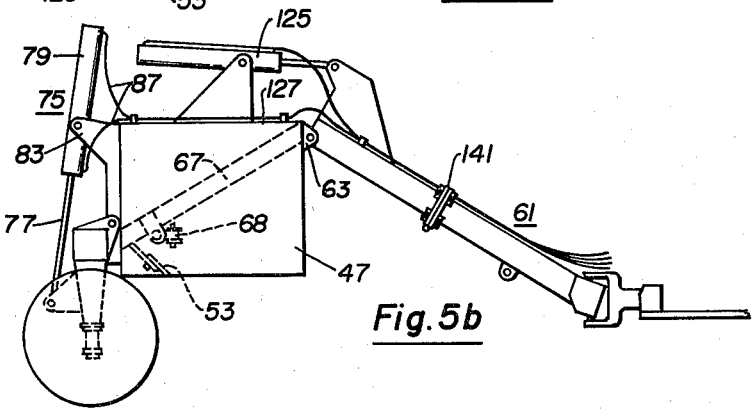

The second step (FIG. 5*b*) is manual activation of the hydraulic control of the hoist rams between the scraper chassis assembly and the ground engaging support means, which extends the rods 77 and draws the scraper chassis assembly to a position near the top of the wheels 19. At the same time, activating hydraulic controls (not shown) to a drawbar tilting ram 125, allows the top of the chassis assembly 127 to be raised essentially parallel to the ground.

Figure 5C:
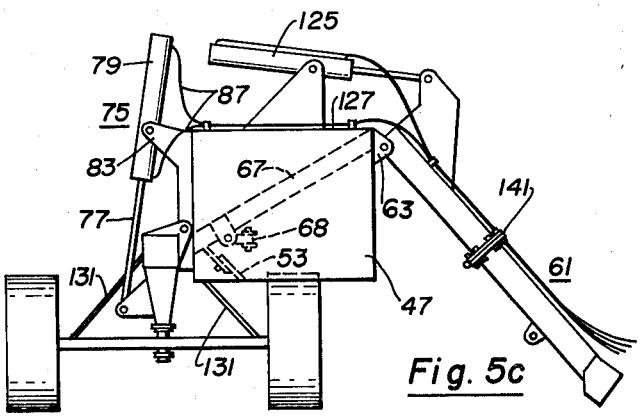
Figure 5D:
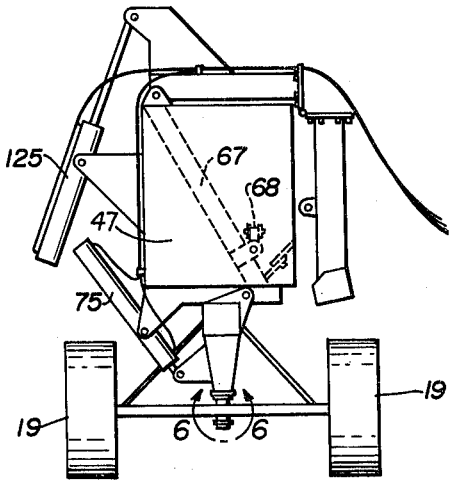
Figure 6:
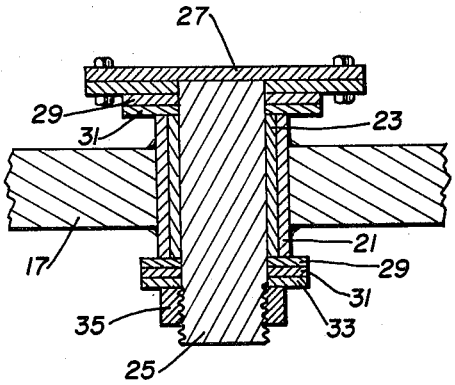
FIG. 6 is a view in section depicting a pivotal axle connection on the plane 6—6 of FIG. 5(*d*).

The third step (FIG. 5*c*) involves placing a hydraulic jack (not shown) at the pivotal connecting point of the end arm and axle assemblies and raising this point to relieve the scraper weight from the axle, rotating it 90 degrees parallel to the length of the chassis assembly, and locking the axle into this position by installing a pair of stabilizing rods 131 from a fixed point under the cross beam to points on the axle on either side of the end member. The jack is then lowered and the step is repeated on the other axle where a pulling draw bar 133 is similarly installed.

At this time the main draw bar 61 is disconnected from the tractor and lowered to the ground and the hinged section unbolted.

The fourth step involves simultaneously retracting the hoist rams and extending the draw-bar tilting ram, rotating the scraper chassis assembly about its rotatable connection to the ground engaging support means, to a upright position ready for transport. The loose hinged section of tl e draw bar now takes a position hanging by the side of the upright chassis assembly.

The unit may now be hitched by its draw-bar to the tractor or a regular highway truck transporting unit for towing along highways to or from jobs.

From the foregoing description of my invention in its preferred form, it will become apparent that the same is subject to alteration and modification, without departing from the underlying principles involved, and I do not desire to be limited in my protection to the specific details illustrated and described except as may be necessitated by the appended claims.

I claim:

1. Earth grading means adaptable for towing along a single lane of highway comprising ground engaging support means including wheels employable for both grading and highway use, a scraper chassis assembly having a scraper blade, means rotatably connecting said scraper chassis assembly to said ground engaging support means for movement in a vertical plane, hydraulically driven grade control adjustment means between said ground engaging support means and said scraper chassis assembly for controlling vertical relationships between said ground engaging support means and said scraper chassis assembly, and means orienting said wheels between a position normal to the longitudinal axis of said scraper chassis assembly to a position parallel to such axis suitable for highway use, whereby, when not in the process of grading, said grade control hydraulics may, in cooperation with said ground engaging support means and said scraper chassis assembly, convert said grading means for highway towing on said highway employable wheels.

2. Earth grading means in accordance with claim 1, characterized by said ground engaging support means adjustably supported behind said scraper chassis assembly to control position of said blade relative to said ground engaging support means during grading operations.

3. Earth grading means in accordance with claim 1, characterized by means vertically rotating said scraper chassis assembly to a position above said ground engaging support means to convert said earth grading means from a ground position suitable for scraping to an elevated position over said wheels suitable when towing along a single lane of highway.

4. Earth grading means in accordance with claim 3 characterized by said means orienting said wheels including an axle between wheel pairs, a wheel frame supported between said axles and means rotating said axles with respect to said wheel frame, whereby, for towing along a single land of a highway, said wheels may be rotated to a position parallel to the longitudinal axis of said scraper chassis assembly.

5. Earth grading means in accordance with claim 1, characterized by means responsive to irregularities of surface engaged by said ground engaging support means for automatically adjusting said scraper blade toward a fixed plane of scraping, said ground engaging support means including means for minimizing creation of oscillations that might otherwise be established when said automatic adjusting means does not have adequate time to completely adjust from a prior surface irregularity before encountering a new irregularity.

6. Earth grading equipment in accordance with claim 5, characterized by said scraper chassis assembly having end plates and said means for minimizing oscillations including a wheel frame having end members, each of said members providing a supporting point for said chassis assembly, means supporting said end members by a wide axle of a length substantially the width of said scraper chassis assembly end plates and said wide axles having wheels on each end thereof, whereby, surface irregularities in the path of one of said wheels resulting in deflection of said wheel causes resulting deflection of said supporting point to a lesser degree that would otherwise happen with both wheels subjected to such irregularity and with a consequent lesser compensating adjustment necessary from said automatic adjusting means.

7. Earth grading equipment in accordance with claim 1, characterized by means responsive to irregularities of surface engaged by said ground engaging support ments for automatically controlling said grade adjustment means to adjust said scraper blade toward a fixed plane of scraping, means including said automatic control means and said grade adjustment means to adjust said scraper to grade cross sloping surfaces.

8. Earth grading equipment in accordance with claim 7, characterized by said ground engaging support means including a wheel frame having a beam with end members, means supporting each of said end members by a wheeled axle to provide a supporting point for said chassis assembly, means separating said beam into disjointed segments with means relative to each segment for receiving an external signal at said automatic controlling means to independently adjust said associated chassis assembly support point in response to such signal.

9. In earth grading equipment including a ground engaging support means, a scraper chassis assembly including a scraper blade and end plates, means rotatably connecting said scraper chassis assembly in front of said ground engaging support means, and means responsive to irregularities of surface engaged by said ground engaging support means for automatically adjusting said scraper blade toward a fixed plane of scraping, said ground engaging support means including means for minimizing creation of oscillations that might otherwise be established when said automatic adjusting means does not have adequate time to completely adjust from a prior irregularity of surface before encountering a new irregularity, said means for minimizing oscillations including a wheel frame having end members, each of said end members providing a supporting point for said chassis assembly, means supporting said end members by a wide axle of a length substantially the width of said scraper chassis assembly end plates and said wide axles having wheels on each end thereof, whereby, surface irregularities in the path of any one of said wheels resulting in deflection of said wheel cause resultant deflection of said supporting point to a lesser degree then would otherwise happen with both wheels subjected to such irregularity and with consequent lesser compensating adjustment necessary from said automatic adjusting means.

10. In earth grading equipment including a ground engaging support means, a scraper chassis assembly including a scraper blade, means rotatably connecting said scraper chassis assembly in front of said ground engaging support means, said ground engaging support means including a wheel frame having a beam with end members, means supporting each of said end members by a wheeled axle, means receiving a control signal to adjust said scraper chassis assembly and blade relative to said wheel axles, means responsive to irregularities of surface engaged by said ground engaging support means for automatically adjusting said scraper blade toward a fixed plane of scraping, and means including said scraper blade adjusting means for adjusting said scraper blade to grade cross sloping surfaces in either lateral direction, said means adjusting said scraper to grade cross sloping surfaces including means for separating said beam into two disjointed segments resulting in each of said segments contributing independent support to a proximate end point of said scraper chassis assembly, means supporting each of said segments by one of said wheeled axles, means supported with respect to each segment for receiving a control signal, and means responsive to such signal for independently adjusting said associated chassis assembly support point.

* * * * *